US011133605B2

(12) United States Patent
Wei

(10) Patent No.: US 11,133,605 B2
(45) Date of Patent: Sep. 28, 2021

(54) ANTENNA STRUCTURE

(71) Applicant: Wistron NeWeb Corp., Hsinchu (TW)

(72) Inventor: Shih-Chiang Wei, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 735 days.

(21) Appl. No.: 15/611,028

(22) Filed: Jun. 1, 2017

(65) Prior Publication Data

US 2018/0048076 A1 Feb. 15, 2018

(30) Foreign Application Priority Data

Aug. 11, 2016 (TW) ..... 105212154

(51) Int. Cl.

| | |
|---|---|
| ***H01Q 5/371*** | (2015.01) |
| ***H01Q 1/24*** | (2006.01) |
| ***H01Q 9/42*** | (2006.01) |
| ***H01Q 9/04*** | (2006.01) |
| ***H01Q 21/30*** | (2006.01) |

(52) U.S. Cl.

CPC ..... *H01Q 21/30* (2013.01); *H01Q 1/242* (2013.01); *H01Q 1/243* (2013.01); *H01Q 5/371* (2015.01); *H01Q 9/045* (2013.01); *H01Q 9/0421* (2013.01); *H01Q 9/42* (2013.01)

(58) Field of Classification Search

CPC . H01Q 1/242–244; H01Q 5/371; H01Q 21/30
See application file for complete search history.

(56) References Cited

U.S. PATENT DOCUMENTS

| | | | | |
|---|---|---|---|---|
| 7,289,071 | B2 * | 10/2007 | Hung | H01Q 9/42 343/702 |
| 8,638,271 | B2 * | 1/2014 | Wang | H01Q 5/364 343/846 |
| 8,779,986 | B2 * | 7/2014 | Fan | H01Q 9/42 343/700 MS |
| 9,905,912 | B2 * | 2/2018 | Wu | H01Q 1/243 |
| 2012/0299781 | A1 * | 11/2012 | Lee | H01Q 9/42 343/700 MS |
| 2012/0313827 | A1 * | 12/2012 | Kim | H01Q 1/243 343/702 |
| 2015/0200456 | A1 * | 7/2015 | You | H01Q 9/42 343/722 |
| 2015/0200457 | A1 * | 7/2015 | Chan | H01Q 5/357 343/700 MS |

* cited by examiner

*Primary Examiner* — Andrea Lindgren Baltzell
*Assistant Examiner* — Amal Patel
(74) *Attorney, Agent, or Firm* — McClure, Qualey & Rodack, LLP

(57) ABSTRACT

An antenna structure includes a ground plane, a feeding connection element, a first radiation element, a second radiation element, a third radiation element, and a shorting radiation element. The feeding connection element is coupled to a signal source. The first radiation element and the second radiation element are coupled to the feeding connection element. The second radiation element and the first radiation element substantially extend in opposite directions. The third radiation element is coupled to the ground plane. The third radiation element partially surrounds the second radiation element. The shorting radiation element is coupled between the feeding connection element and the third radiation element.

19 Claims, 3 Drawing Sheets

ANTENNA STRUCTURE

CROSS REFERENCE TO RELATED APPLICATIONS

This Application claims priority of Taiwan Patent Application No. 105212154 filed on Aug. 11, 2016, the entirety of which is incorporated by reference herein.

BACKGROUND OF THE INVENTION

Field of the Invention

The disclosure generally relates to an antenna structure, and more particularly, to a wideband, planar antenna structure.

Description of the Related Art

With advancements in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi, Bluetooth and WiMAX (Worldwide Interoperability for Microwave Access) systems and using frequency bands of 2.4 GHz, 3.5 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, wideband antenna element.

BRIEF SUMMARY OF THE INVENTION

In an exemplary embodiment, the disclosure is directed to an antenna structure including a ground plane, a feeding connection element, a first radiation element, a second radiation element, a third radiation element, and a shorting radiation element. The feeding connection element is coupled to a signal source. The first radiation element and the second radiation element are coupled to the feeding connection element. The second radiation element and the first radiation element substantially extend in opposite directions. The third radiation element is coupled to the ground plane. The third radiation element partially surrounds the second radiation element. The shorting radiation element is coupled between the feeding connection element and the third radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
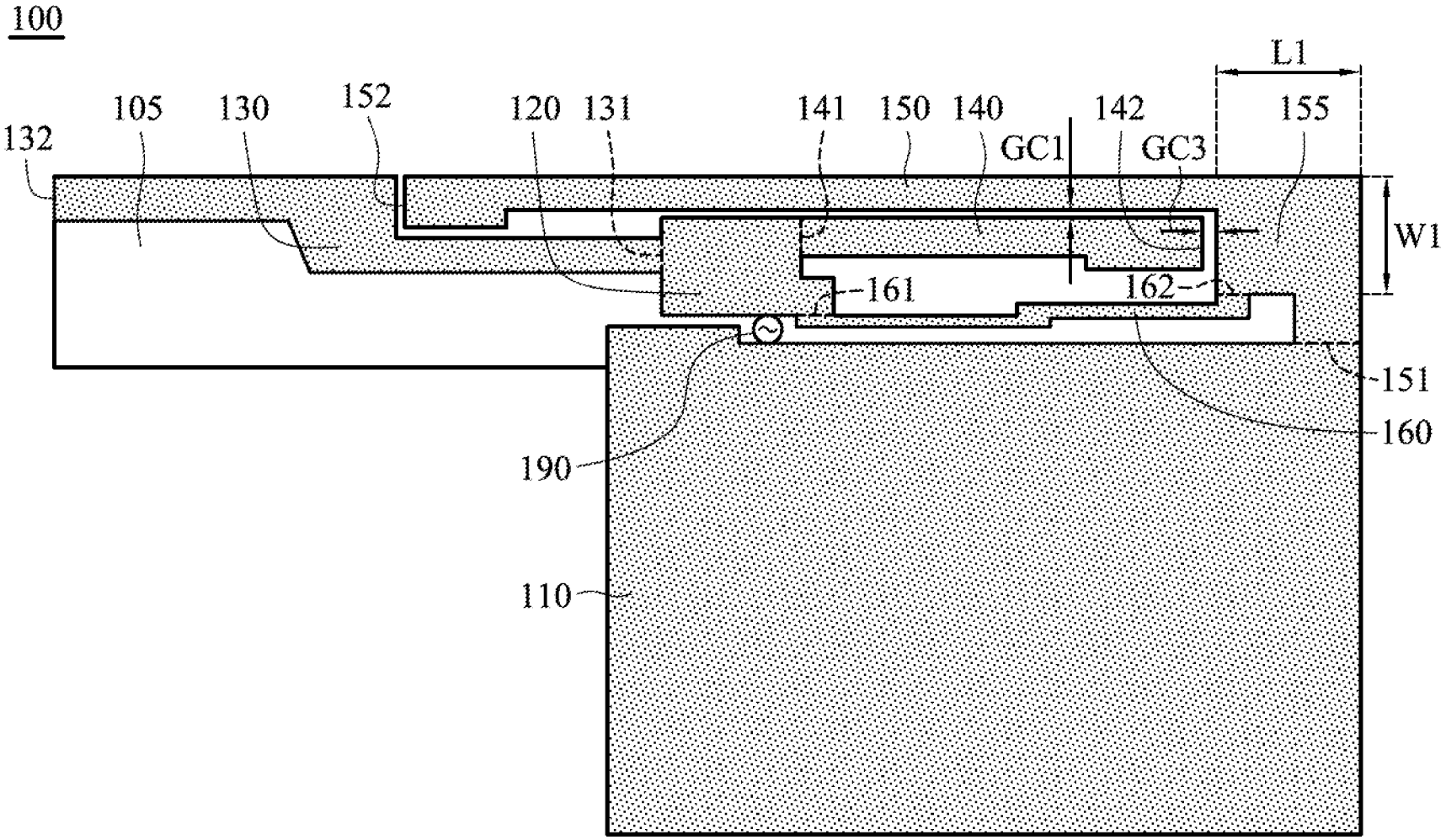
FIG. 1 is a diagram of an antenna structure according to an embodiment of the invention.

FIG. 1 is a diagram of an antenna structure 100 according to an embodiment of the invention. The antenna structure 100 may be applied in a mobile device, such as a smartphone, a table computer, or a notebook computer. As shown in FIG. 1, the antenna structure 100 includes a ground plane 110, a feeding connection element 120, a first radiation element 130, a second radiation element 140, a third radiation element 150, and a shorting radiation element 160. The above elements may be made of metal materials, such as copper, silver, aluminum, iron, or their alloys. The ground plane 110 may substantially be a rectangular metal plate, which can provide a ground voltage. The feeding connection element 120, the first radiation element 130, the second radiation element 140, the third radiation element 150, and the shorting radiation element 160 may be disposed on a dielectric substrate 105, such as an FR4 (Flame Retardant 4) substrate or a system circuit board, so as to form a planar antenna structure.

The feeding connection element 120 may substantially have a rectangular shape. The feeding connection element 120 is coupled to a signal source 190. The signal source 190 may be an RF (Radio Frequency) module for exciting the antenna structure 100. The first radiation element 130 may substantially have an N-shape. The first radiation element 130 has a first end 131 and a second end 132. The first end 131 of the first radiation element 130 is coupled to the feeding connection element 120, and the second end 132 of the first radiation element 130 is open. The second radiation element 140 may substantially have a straight-line shape. The second radiation element 140 has a first end 141 and a second end 142. The first end 141 of the second radiation element 140 is coupled to the feeding connection element 120, and the second end 142 of the second radiation element 140 is open. In some embodiments, a terminal bend or a terminal widening portion is formed at the second end 142 of the second radiation element 140. The second end 142 of the second radiation element 140 and the second end 132 of the first radiation element 130 substantially extend in opposite directions. A combination of the feeding connection element 120, the first radiation element 130, and the second radiation element 140 substantially has a T-shape. The third radiation element 150 may substantially have an L-shape. The third radiation element 150 has a first end 151 and a second end 152. The first end 151 of the third radiation element 150 is coupled to the ground plane 110, and the second end 152 of the third radiation element 150 is open and adjacent to a central bend portion of the first radiation element 130. In some embodiments, a terminal bend or a terminal widening portion is formed at the second end 152 of the third radiation element 150. The third radiation element 150 partially surrounds the second radiation element 140. For example, a straight-line-shaped slot may be defined by the third radiation element 150 and the ground plane 110, and the second radiation element 140 and the shorting radiation element 160 may be disposed in the aforementioned slot. In some embodiments, the feeding connection element 120 and a portion of the first radiation element 130 are disposed in the aforementioned slot, such that the coupling is induced between the third radiation element 150 and each of the first radiation element 130, the second radiation element 140, and the feeding connection element 120. In some embodiments, the third radiation element 150 further includes a rectangular widening portion 155, and the rectangular widening portion 155 is positioned at a bend of the third radiation element 150. The shorting radiation element 160 may substantially have a straight-line shape or an N-shape. The shorting radiation element 160 has a first end 161 and a second end 162. The first end 161 of the shorting radiation element 160 is coupled to the feeding connection element 120, and the second end 162 of the shorting radiation element 160 is coupled to the rectangular widening portion 155 of the third radiation element 150. With respect to the relative position of elements, the second radiation element 140 is positioned between the third radiation element 150 and the shorting radiation element 160, and the shorting radiation element 160 is positioned between the second radiation element 140 and the ground plane 110.

It should be noted that the above element shapes may be fine-tuned in response to different requirements. Each radiation element of FIG. 1 has one or more bends and irregular edges for optimizing the impedance matching of the antenna structure 100, but the bends and edges may be replaced with smooth shapes in other embodiments. For example, adjustments may be made so that the first radiation element 130 has an L-shape and the shorting radiation element 160 has a straight-line shape.

Figure 2:
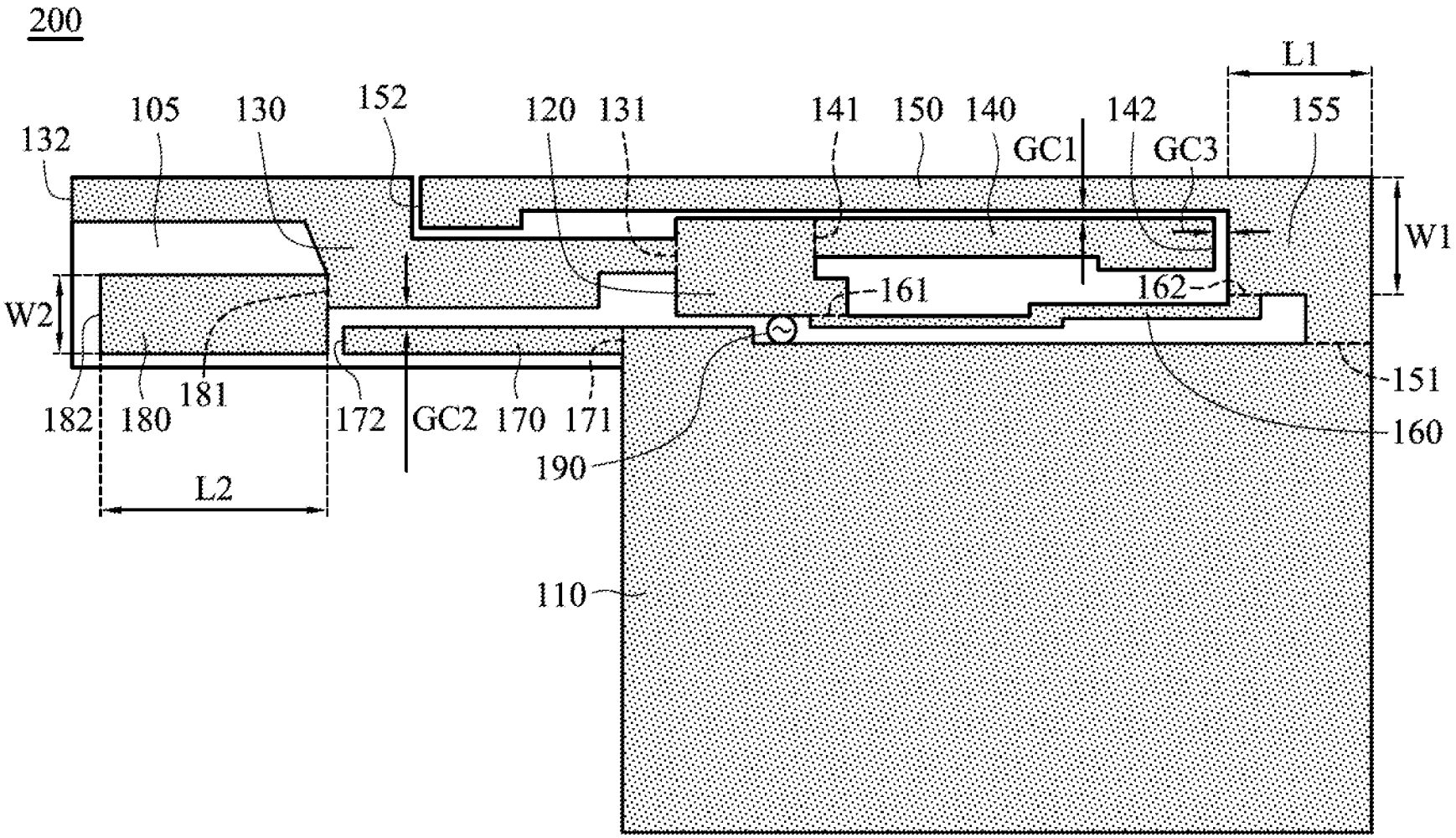
FIG. 2 is a diagram of an antenna structure according to another embodiment of the invention.

FIG. 2 is a diagram of an antenna structure 200 according to an embodiment of the invention. FIG. 2 is similar to FIG. 1. In the embodiment of FIG. 2, the antenna structure 200 further includes a fourth radiation element 170 and a fifth radiation element 180. The above elements may be made of metal materials, such as copper, silver, aluminum, iron, or their alloys. The fourth radiation element 170 and the fifth radiation element 180 may be disposed on the dielectric substrate 105. The fourth radiation element 170 may substantially have a straight-line shape. The fourth radiation element 170 has a first end 171 and a second end 172. The first end 171 of the fourth radiation element 170 is coupled to the ground plane 110, and the second end 172 of the fourth radiation element 170 is open. The fourth radiation element 170 is substantially parallel to at least a part of the first radiation element 130. The fifth radiation element 180 may substantially have a rectangular shape. The fifth radiation element 180 has a first end 181 and a second end 182. The first end 181 of the fifth radiation element 180 is coupled to a central bend portion of the first radiation element 130, and the second end 182 of the fifth radiation element 180 is open. The second end 182 of the fifth radiation element 180 and the second end 132 of the first radiation element 130 substantially extend in the same direction. A combination of the first radiation element 130 and the fifth radiation element 180 may substantially have a Y-shape.

Figure 3:
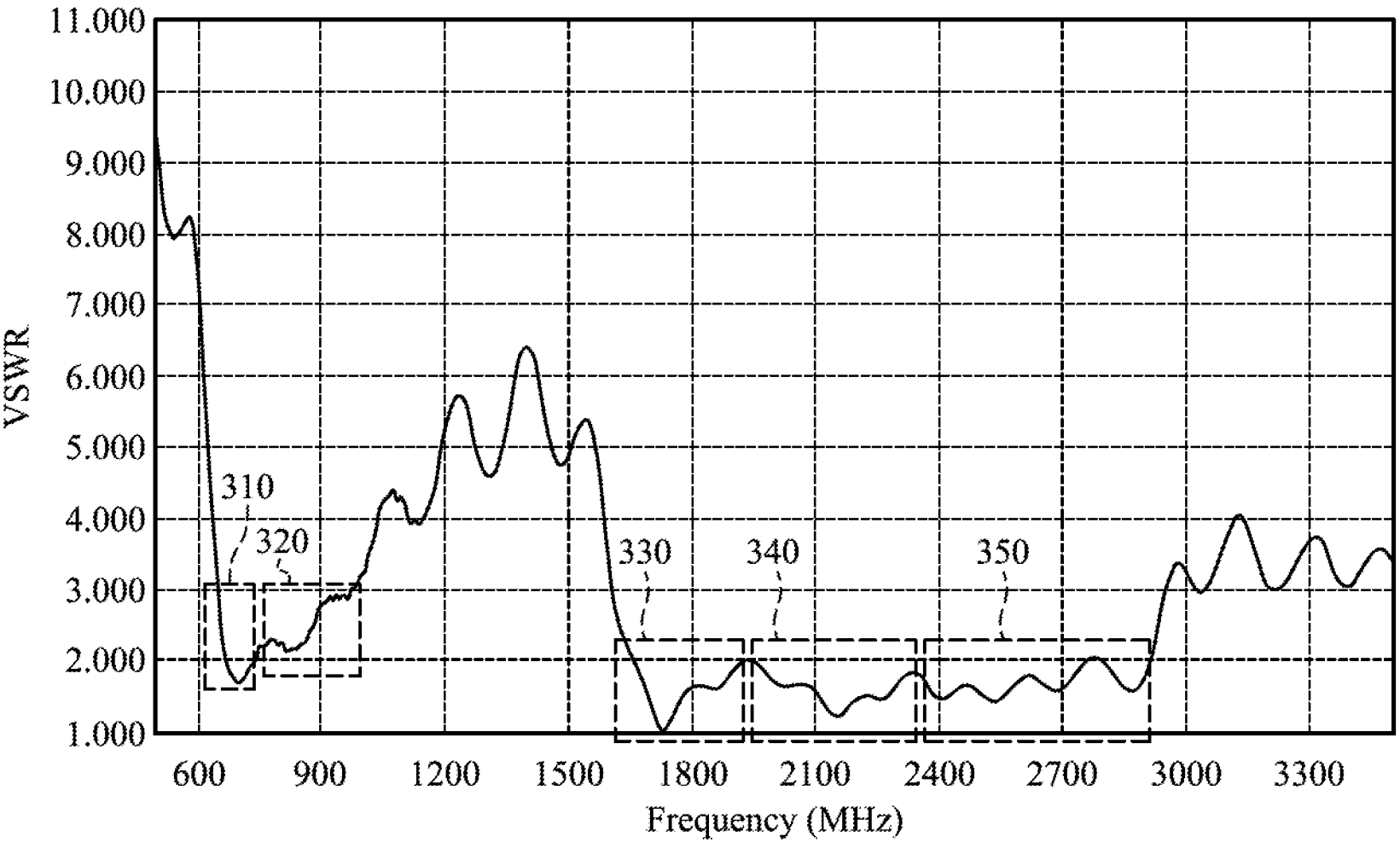
FIG. 3 is a diagram of a VSWR (Voltage Standing Wave Ratio) of an antenna structure according to an embodiment of the invention.

FIG. 3 is a diagram of a VSWR (Voltage Standing Wave Ratio) of the antenna structure 200 according to an embodiment of the invention. The vertical axis represents the operation frequency (MHz), and the horizontal axis represents the VSWR. According to the measurement of FIG. 3, the antenna structure 200 can cover a first low-frequency band 310 from about 699 MHz to about 787 MHz, a second low-frequency band 320 from about 787 MHz to about 960 MHz, a first high-frequency band 330 from about 1710 MHz to about 1930 MHz, a second high-frequency band 340 from about 1930 MHz to about 2300 MHz, and a third high-frequency band 350 from about 2300 MHz to about 2900 MHz. Therefore, the antenna structure 200 can support all of the frequency bands of LTE (Long Term Evolution). According to practical measurement results, the antenna efficiency of the antenna structure 200 is about −3 dB in the low-frequency band, and is about −3.5 dB in the high-frequency band. Such antenna efficiency can meet the requirements of practical application of general mobile communication devices.

Please refer to FIG. 2 and FIG. 3 together. The operation theory of the antenna structure 200 may be as follows. The first low-frequency band 310 is mainly excited by the third radiation element 150, and the length of the third radiation element 150 is substantially equal to 0.25 wavelength (214) of the first low-frequency band 310. The second low-frequency band 320 is mainly excited by the feeding connection element 120 and the first radiation element 130, and the total length of the feeding connection element 120 and the first radiation element 130 is substantially equal to 0.25 wavelength (214) of the second low-frequency band 320. The first high-frequency band 330 is mainly excited by the feeding connection element 120 and the second radiation element 140, and the total length of the feeding connection element 120 and the second radiation element 140 is substantially equal to 0.25 wavelength (214) of the first high-frequency band 330. The second high-frequency band 340 is mainly excited by the fourth radiation element 170, and the length of the fourth radiation element 170 is substantially equal to 0.25 wavelength (214) of the second high-frequency band 340. The third high-frequency band 350 is mainly excited by the shorting radiation element 160, and the length of the shorting radiation element 160 is substantially equal to 0.5 wavelength (212) of the third high-frequency band 350.

According to practical measurement results, when the antenna structure 200 operates in the first low-frequency band 310, its maximum current density is formed on the shorting radiation element 160. Such a shorting radiation element 160 can improve the low-frequency impedance matching of the antenna structure 200, thereby increasing the low-frequency bandwidth of the antenna structure 200. A first coupling gap GC1 is formed between the second radiation element 140 and the third radiation element 150, and the first coupling gap GC1 is used to fine-tune the impedance matching of the first low-frequency band 310, the second low-frequency band 320, and the first high-frequency band 330. The width of the first coupling gap GC1 may be smaller than 3 mm, so as to increase the mutual coupling between elements. A second coupling gap GC2 is formed between the first radiation element 130 and the fourth radiation element 170, and the second coupling gap GC2 is used to fine-tune the impedance matching of the second high-frequency band 340. The width of the second coupling gap GC2 may be smaller than 5 mm, so as to increase the mutual coupling between elements. In addition, a third coupling gap GC3 is formed between the second end 142 of the second radiation element 140 and the rectangular widening portion 155 of the third radiation element 150, and the third coupling gap GC3 is used to fine-tune the impedance matching of the first low-frequency band 310, the second low-frequency band 320, and the first high-frequency band 330. The width of the third coupling gap GC3 may be smaller than 3 mm. The rectangular widening portion 155 of the third radiation element 150 and the rectangular fifth radiation element 180 both help to increase the high-frequency bandwidth and the low-frequency bandwidth of the antenna structure 200. The length L1 of the rectangular widening portion 155 of the third radiation element 150 may be from 8 mm to 10 mm, such as 9 mm. The width W1 of the rectangular widening portion 155 of the third radiation element 150 may be from 6 mm to 8 mm, such as 7 mm. The length L2 of the fifth radiation element 180 may be from 13 mm to 17 mm, such as 15 mm. The width W2 of the fifth radiation element 180 may be from 4 mm to 6 mm, such as 5 mm. The above element sizes are calculated according to experimental results repeated many times, and they can optimize the impedance matching of the antenna structure 200.

The embodiments of the invention propose a novel antenna structure. In comparison to the conventional antenna design, the proposed design has at least the advantages of: (1) being a planar antenna design, (2) being easy to manufacture a large amount of identical products, (3) covering all of the LTE frequency bands, (4) minimizing the total size, and (5) having low manufacturing costs. Therefore, the proposed antenna structure is suitable for application in a variety of small-size mobile communication devices.

Note that the above element sizes, element parameters, element shapes, and frequency ranges are not limitations of the invention. An antenna designer can fine-tune these settings or values according to different requirements. It should be understood that the antenna structure of the invention is not limited to the configurations of FIGS. 1-3. The invention may merely include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground plane;

a feeding connection element, connected to a signal source;

a first radiation element, connected to the feeding connection element;

a second radiation element, connected to the feeding connection element, wherein the second radiation element and the first radiation element substantially extend in opposite directions;

a third radiation element, connected to the ground plane, and partially surrounding the second radiation element, wherein the third radiation element further comprises a widening portion; and a shorting radiation element, wherein a first end of the shorting radiation element is connected to the feeding connection element, and a second end of the shorting radiation element is connected to the widening portion of the third radiation element;

wherein the antenna structure covers a first low-frequency band and a second low-frequency band;

wherein a coupling is induced between the third radiation element and each of the second radiation element, the feeding connection element, and the first radiation element.

2. The antenna structure as claimed in claim 1, wherein the third radiation element is spaced apart from the second radiation element, the feeding connection element, and the first radiation element.

3. The antenna structure as claimed in claim 1, wherein the feeding connection element, the first radiation element, and the second radiation element together form a T-shape.

4. The antenna structure as claimed in claim 1, wherein the third radiation element is substantially in an L-shape.

5. The antenna structure as claimed in claim 1, wherein a coupling is induced between an open end of the second radiation element and the widening portion of the third radiation element.

6. The antenna structure as claimed in claim 1, further comprising:

a fourth radiation element, connected to the ground plane, wherein the fourth radiation element is substantially parallel to a part of the first radiation element, and wherein the antenna structure further covers a first high-frequency band, a second high-frequency band, and a third high-frequency band.

7. The antenna structure as claimed in claim 6, wherein the fourth radiation element substantially has a straight-line shape.

8. The antenna structure as claimed in claim 6, further comprising:

a fifth radiation element, connected to the first radiation element, wherein the fifth radiation element and the first radiation element substantially extend in the same direction.

9. The antenna structure as claimed in claim 8, wherein a width of the fifth radiation element is larger than a width of a connection portion coupled between the fifth radiation element and the first radiation element.

10. The antenna structure as claimed in claim 8, wherein the first radiation element and the fifth radiation element substantially form a Y-shape.

11. The antenna structure as claimed in claim 6, wherein the first low-frequency band is from about 699 MHz to about 787 MHz, the second low-frequency band is from about 787 MHz to about 960 MHz, the first high-frequency band is from about 1710 MHz to about 1930 MHz, the second high-frequency band is from about 1930 MHz to about 2300 MHz, and the third high-frequency band is from about 2300 MHz to about 2900 MHz.

12. The antenna structure as claimed in claim 1, wherein a length of the third radiation element is substantially equal to 0.25 wavelength of the first low-frequency band.

13. The antenna structure as claimed in claim 6, wherein a total length of the feeding connection element and the second radiation element is substantially equal to 0.25 wavelength of the first high-frequency band.

14. The antenna structure as claimed in claim 6, wherein a length of the fourth radiation element is substantially equal to 0.25 wavelength of the second high-frequency band.

15. The antenna structure as claimed in claim 6, wherein a length of the shorting radiation element is substantially equal to 0.5 wavelength of the third high-frequency band.

16. The antenna structure as claimed in claim 6, wherein a first coupling gap is formed between the second radiation element and the third radiation element, a second coupling gap is formed between the first radiation element and the fourth radiation element, and a third coupling gap is formed between an open end of the second radiation element and the widening portion of the third radiation element.

17. The antenna structure as claimed in claim 16, wherein a width of the first coupling gap is smaller than 3 mm, a width of the second coupling gap is smaller than 5 mm, and a width of the third coupling gap is smaller than 3 mm.

18. The antenna structure as claimed in claim 1, wherein a total length of the feeding connection element and the first radiation element is substantially equal to 0.25 wavelength of the second low-frequency band.

19. An antenna structure, comprising:

a ground plane;

a feeding connection element, connected to a signal source;

a first radiation element, connected to the feeding connection element;

a second radiation element, connected to the feeding connection element, wherein the second radiation element and the first radiation element substantially extend in opposite directions;

a third radiation element, connected to the ground plane, and partially surrounding the second radiation element, wherein the third radiation element further comprises a widening portion; and a shorting radiation element, wherein a first end of the shorting radiation element is connected to the feeding connection element, and a second end of the shorting radiation element is connected to the widening portion of the third radiation element;

wherein the antenna structure covers a first low-frequency band and a second low-frequency band;

wherein a coupling is induced between an open end of the second radiation element and the widening portion of the third radiation element.

* * * * *